US010808392B2

(12) United States Patent
Bhatia et al.

(10) Patent No.: US 10,808,392 B2
(45) Date of Patent: Oct. 20, 2020

(54) DRAIN TRENCH BODY AND CENTER PLATE

(71) Applicant: ACO SEVERIN AHLMANN GMBH & CO KOMMANDITGESELLSCHAFT, Budelsdorf (DE)

(72) Inventors: Ramon Bhatia, Rendsburg (DE); Jan Mieze, Kiel (DE); Marco Wandkowski, Kronshagen (DE)

(73) Assignee: ACO SEVERIN AHLMANN GMBH & CO. KOMMANDITGESELLSCHAFT, Budelsdorf (DE)

( * ) Notice: Subject to any disclaimer, the term of this patent is extended or adjusted under 35 U.S.C. 154(b) by 0 days.

(21) Appl. No.: 16/491,337

(22) PCT Filed: Mar. 7, 2018

(86) PCT No.: PCT/EP2018/055546
§ 371 (c)(1),
(2) Date: Sep. 5, 2019

(87) PCT Pub. No.: WO2018/162524
PCT Pub. Date: Sep. 13, 2018

(65) Prior Publication Data

US 2020/0032500 A1 Jan. 30, 2020

(30) Foreign Application Priority Data

Mar. 9, 2017 (DE) ..... 10 2017 105 011

(51) Int. Cl.
*E03F 1/00* (2006.01)
*E02B 11/00* (2006.01)

(52) U.S. Cl.
CPC ..... *E03F 1/005* (2013.01); *E02B 11/005* (2013.01)

(58) Field of Classification Search
CPC ..... E03F 1/003; E03F 1/005; E02B 11/00; E02B 1/005
(Continued)

(56) References Cited

U.S. PATENT DOCUMENTS 6,428,870 B1 * 8/2002 Bohnhoff ..... E02B 11/00 405/50
7,080,480 B2 * 7/2006 Urban ..... E01C 9/005 47/48.5
(Continued)

FOREIGN PATENT DOCUMENTS

CA 2961122 A1 * 3/2016 ..... E02B 11/005
CN 102575445 A 7/2012
(Continued)

OTHER PUBLICATIONS

International Search Report issued in International PCT Application No. PCT/EP2018/055546; dated Sep. 27, 2018.
(Continued)

*Primary Examiner* — Frederick L Lagman
(74) *Attorney, Agent, or Firm* — Pearne & Gordon LLP

(57) ABSTRACT

The invention relates to a drain trench body having base plates (11, 12), between which columns (13) are arranged vertically. The drain trench body comprises side walls (14) which are connected to the base plates (11, 12). The side walls (14) and the base plates (11, 12) have first and second locking elements (15, 16) which are in engagement with each other. The locking elements (15, 16) are movable relative to one another in the height direction along the longitudinal axis of the columns (13). The invention further relates to a center plate (20) for a drain trench body.

11 Claims, 6 Drawing Sheets

(58) Field of Classification Search
USPC ..... 405/53, 55
See application file for complete search history.

(56) References Cited

U.S. PATENT DOCUMENTS

| | | | | |
|---|---|---|---|---|
| 7,591,610 | B2 * | 9/2009 | Krichten | E03F 1/005 405/50 |
| 7,704,011 | B2 * | 4/2010 | Marshall | E01C 3/006 404/29 |
| 8,065,831 | B2 * | 11/2011 | Ray | A01G 13/0237 47/32.7 |
| 2007/0181197 | A1 * | 8/2007 | Krichten | E03F 1/005 137/833 |
| 2007/0217866 | A1 * | 9/2007 | Oscar | B65D 88/022 405/36 |
| 2010/0021236 | A1 | 1/2010 | Kreikemeier | |
| 2010/0200600 | A1 * | 8/2010 | Hoekstra | E03F 5/101 220/676 |
| 2012/0255624 | A1 * | 10/2012 | Canney | E03F 1/002 137/315.01 |
| 2013/0152499 | A1 * | 6/2013 | Kriekemeier | E03F 1/005 52/588.1 |
| 2014/0291221 | A1 | 10/2014 | Adams et al. | |
| 2019/0145112 | A1 * | 5/2019 | Gooden | E01C 3/006 404/17 |

FOREIGN PATENT DOCUMENTS

| | | | | | |
|---|---|---|---|---|---|
| CN | 103650978 | A | | 3/2014 | |
| CN | 103882910 | A | | 6/2014 | |
| CN | 104066903 | A | | 9/2014 | |
| DE | 102011086016 | A1 | | 5/2013 | |
| EP | 1416099 | A2 | | 3/2004 | |
| EP | 1743984 | A1 | * | 1/2007 | E03B 3/03 |
| EP | 1997970 | A1 | * | 12/2008 | E03B 3/03 |
| EP | 2463449 | A1 | | 6/2012 | |
| EP | 2592194 | A1 | * | 5/2013 | E03F 1/005 |
| EP | 2862982 | A1 | * | 4/2015 | E03F 1/005 |
| EP | 2980328 | A1 | * | 2/2016 | E03F 1/005 |
| GB | 2518195 | | * | 3/2015 | E03B 3/03 |
| JP | 4533970 | B1 | * | 9/2010 | E03B 3/03 |
| JP | 2013108231 | A | | 6/2013 | |
| WO | 2016042141 | A1 | | 3/2016 | |

OTHER PUBLICATIONS

Office Action issued in corresponding Chinese Patent Application No. 201880016552.8 ; dated Apr. 30, 2020.

* cited by examiner

DRAIN TRENCH BODY AND CENTER PLATE

FIELD

The invention relates to a drain trench body with base plates between which columns are vertically arranged, and side walls to which the base plates are connected. Such a drain trench body is known, for example, from DE 10 2011 086 A1. The invention furthermore relates to a center plate for a drain trench body.

BACKGROUND

Drain trench systems consisting of several drain trench bodies are used to dewater surfaces, wherein the flowing-off water passes through the surface of the drain trench body into the drain trench system and is removed from there, for example, into a sewage plant. Drain trench systems can be wound around by a sheet which rests on the side walls and on the base plates. Water-permeable sheets are used for the seepage of the precipitation water. If the drain trench system is to be used as a water tank, a water-tight sheet is used.

It is important for the stability of the drain trench system that the side walls of the drain trench body are firmly and reliably connected to the base plates. In order to avoid tensions in the drain trench body due to different material properties, usually the same materials are used for the side walls and the base plates.

SUMMARY

The invention is based on the task of improving a drain trench body of the initially cited type in such a manner that sufficient stability of the drain trench body is given independently of which material combination is used for the base plates and side walls. Furthermore, the invention has the basic task of indicating a center plate for a drain trench body.

According to the invention, the task is solved the task is solved as regards the drain trench by the subject matter as disclosed herein. As regards the center plate, the task is solved as described herein.

In particular, the task is solved by a drain trench body with base plates between which columns are vertically arranged. The drain trench body comprises side walls which are connected to the base plates. The side walls and the base plates comprise first and second locking elements which are engaged with one another. The locking elements can move relative to each other in the direction of height along the longitudinal axis of the columns.

The invention has the advantage that different changes in length due to different materials of the side walls and of the base plates can be compensated by relative movements between the locking elements in the direction of height of the drain trench body. To this end, the locking elements can move in the direction of height of the drain trench body. It is achieved, by means of the invention, in that the side walls and the base plates fit together even if different materials are used for the side walls and the base plates. Therefore, a broad selection of material combinations is available, as a result of which the production and the functionality of the side walls and base plates can be individually optimized.

The direction of height along the longitudinal axis of the columns corresponds in the built-in state to the vertical.

Preferred exemplary embodiments of the invention are described herein.

Therefore, the first locking elements are designed as catch elements of the side walls, in particular as catch hooks. The second locking elements can be designed as holding and guiding edges of the base plates. The holding plates and guide plates extend in the direction of the height of the drain trench body. This brings it about that the catch elements of the side walls can slide along the holding and guiding edges, as a result of which the relative motion between the locking elements is made possible in a simple and secure manner.

The holding and guiding edges have a double function here. On the one hand, the edges hold the side walls on the base plates, i.e., in a direction normal to the side walls by the catch hooks engaged with these edges. On the other hand, the edges guide the catch hooks in the direction of height in order to make possible a controlled relative motion. The holding function is of course retained here.

The base plates preferably comprise outer surfaces which extend in the direction of height, wherein the side walls rest on the outer surfaces and can move relative to the outer surfaces. The arrangement of the side walls on the outer surfaces of the base plates leads to an improved removal of load. In addition, the relative mobility of the locking elements and therefore of the side walls and of the base plates is not limited.

In the preferred embodiment the outer surfaces comprise edges. The side walls comprise projections which extend inward, i.e., into the interior of the drain trench body. The projections cooperate with the edges as stops for limiting the relative motion of the side walls in the direction of height. This prevents the locking elements of the side walls and of the base plates from loosening in an unintended manner during strong changes of length. Therefore, the stops offer a safety for maintaining the holding function of the locking elements.

At least one center plate is arranged parallel to the base plates between the columns in the especially preferred embodiment. The center plate reinforces the drain trench body in the horizontal direction. The drain trench body reinforced in this manner can absorb relatively large transverse forces, for example, the surface forces which occur during the introduction in the groundwater.

The center plate is preferably arranged centrally in the drain trench body, i.e., at approximately one half the height of the columns.

The center plate can rest on the at least one side wall in order to directly absorb and disperse the forces introduced into the side wall. The center plate preferably rests on all side walls.

The side walls and the center plate can comprise third and fourth locking elements which engage with each other and can move relative to each other along the longitudinal axis of the columns in the direction of height. This embodiment has the advantage that the center plate and the side walls (and the base plates) can be produced from different materials. Any longitudinal tolerances are compensated by the relative mobility.

Preferably at least one side wall can be divided along a virtual dividing plane running parallel to the base plates. The dividable side wall has the advantage that smaller drain trench bodies can be formed as subunits of the drain trench body with an undivided side wall. The height of the divided side wall substantially corresponds to the height of the columns which are fastened to one of the base plates. The side wall can preferably be centrally divided so that the drain trench body can be halved. The dividable side wall can preferably but not exclusively be used with the previously described center plate. It is also possible to use the dividable side wall with other bottom plates.

The third locking elements of the side walls can be arranged on both sides of the dividing plane. This has the advantage that after the dividing of the side wall both side wall halves can be used to form a drain trench body. If the dividable side wall is used without being divided, the stability of the drain trench body is raised by the arrangement of the third locking elements on both sides of the dividing plane.

The side walls on the one hand and the base plates and/or the center plate on the other hand are preferably produced from different materials. The properties of the drain trench body can be optimized even better by selecting suitable material pairs.

A center plate for a drain trench body with at least one baseplate is described herein which is connected to vertically arranged columns and side walls, wherein the center plate comprises recesses for the columns for arranging the center plate parallel to the base plate. The center plate has the advantage that it can be inserted between the columns before the assembly of the base plates so that in the assembled state of the base plates the center plate is arranged parallel to the base plates and between the columns. The advantages described in conjunction with the drain trench body also apply to the center plate according to the invention. In particular, the center plate imparts a sufficient stability to the drain trench body even in the case of rather large loads such as, for example, when being introduced into groundwater.

According to the invention, the center plate is disclosed in addition to or independently of the locking elements which can move relative to each other. Therefore, a drain trench body is created by the combination of the center plate with the locking elements which body has sufficient stability independent of the material and which is raised even further in the area of the center plate. If, on the other hand, the stability of transverse loads is important, it can be sufficient to provide the drain trench body with a center plate independently of the relative mobility of the locking elements.

BRIEF DESCRIPTION OF DRAWINGS

The invention is explained in detail in the following with further details with refence made to the attached, schematic drawings.

In the drawings.

DETAILED DESCRIPTION

Figure 1:
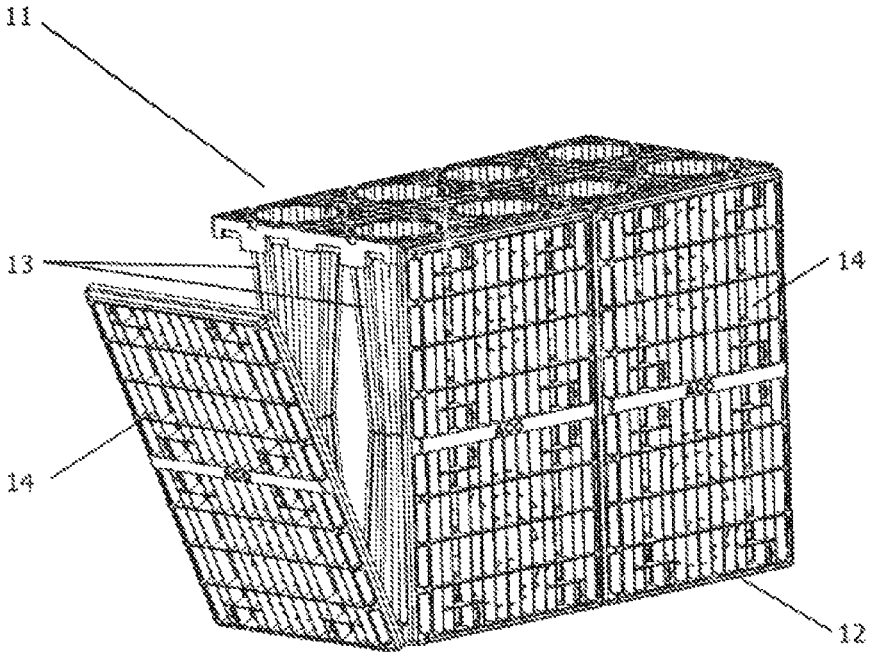
FIG. 1 shows a perspective view of a drain trench body according to an exemplary embodiment of the invention in which the front side wall is folded forward for reasons of presentation.
Figure 2:
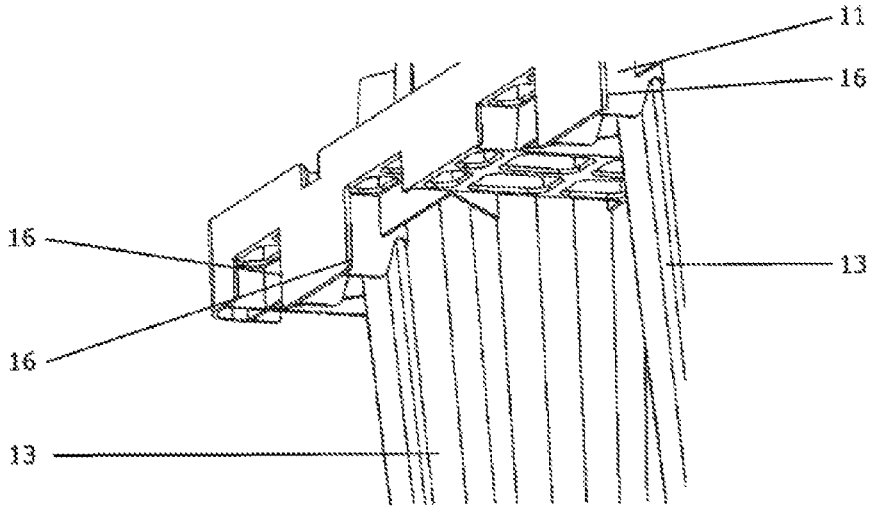
FIG. 2 shows a section of the drain trench body according to FIG. 1 in the area of the first base plate.
Figure 3:
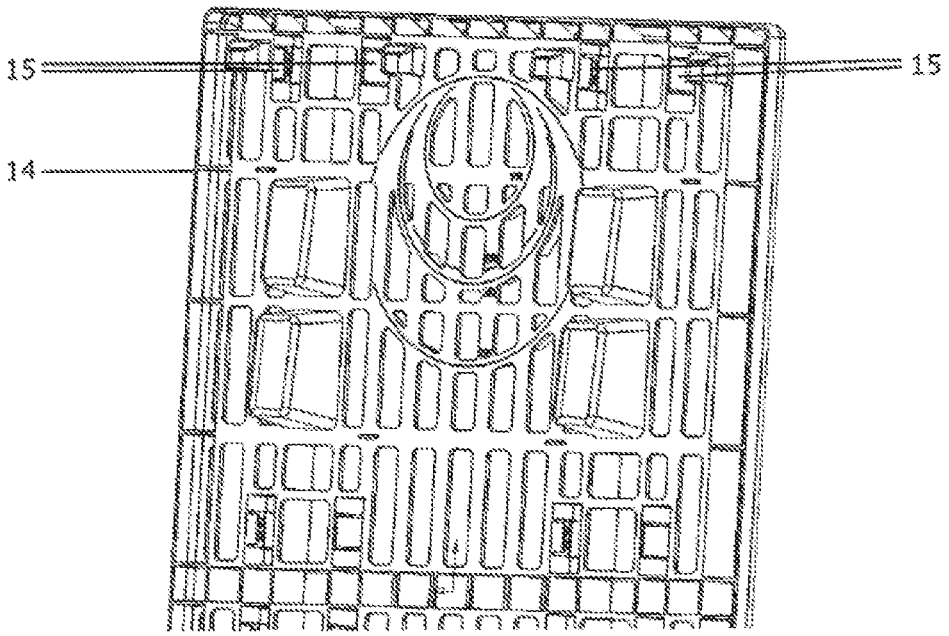
FIG. 3 shows a rear view of a side wall with first locking elements.
Figure 4:
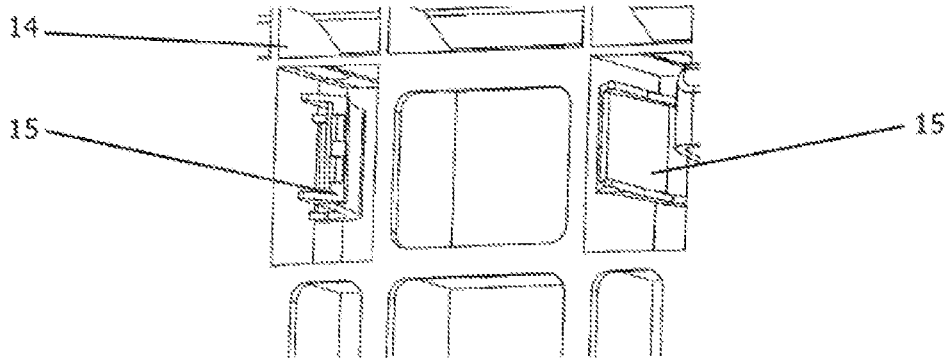
FIG. 4 shows an enlarged section of the side wall according to FIG. 3 in the area of the locking elements.

In the following description the same reference numerals are used for parts which are the same and have the same effect.

The drain trench body according to FIG. 1 is a box-shaped body with grid-like limiting surfaces in the form of base plates 11, 12 and side walls 14 through which water can flow into the drain trench body. The drain trench body can be wound around in a known manner with a geotextile in order to prevent the penetration of sediments into the drain trench body.

A drain trench system composed of several such drain trench bodies serves on the one hand as a block storage for precipitation water and on the other hand for the block seepage of precipitation water.

The drain trench body shown in FIG. 1 comprises identical base plates 11, 12 which can be combined with each other in different manners. The upper base plate 11 is arranged above and the lower base plate 12 is arranged below in the placed state. The location terms "above" and "below" refer to the inserted position of the drain trench body. The terms "outer" and "inner" refer to the drain trench body as a hollow body, wherein "inner" means the inside of the drain trench body and "outer" the surroundings outside of the drain trench body.

The base plates 11, 12 comprise columns 13 which extend vertically to the base plates 11, 12 and are connected to them. The columns 13 form spacers which fix the distance of the base plates 11, 12 from each other. To this end, the columns 13 are set on each other by their free ends. The columns 13, also called pylons, are designed conically, wherein the smaller cross-sectional opening forms the free end and the larger cross-sectional opening forms the end of the particular column 13 which end is connected to the particular base plate 11, 12.

The side walls 14 form the lateral limiting surfaces of the drain trench body. They are arranged over the entire circumference of the two base plates 11, 12 and extend between the base plates 11, 12 so that the drain trench body is completely limited by the side walls 14.

As FIGS. 1 to 6 show, the side walls 14 comprise first locking elements 15. The base plates 11, 12 comprise second locking elements 16. The locking elements 15, 16 are engaged when the side walls 14 and the base plates 11, 12 are connected.

The two locking elements 15, 16 can move relative to one another in the direction of the height of the drain trench body, i.e., along the longitudinal axis of the columns 13. The longitudinal axis of the columns 13 and therefore the direction of height of the drain trench body run in vertical direction in the assembled state. The side walls 14 and the base plates 11, 12 allow a play in the direction of the height of the drain trench body. This effects that longitudinal differences due to different material combinations of the side walls 14 and of the base plates 11, 12 are compensated without the locking elements 15, 16 blocking. The different longitudinal changes can be produced due to different shrinking properties of the materials.

Figure 5:
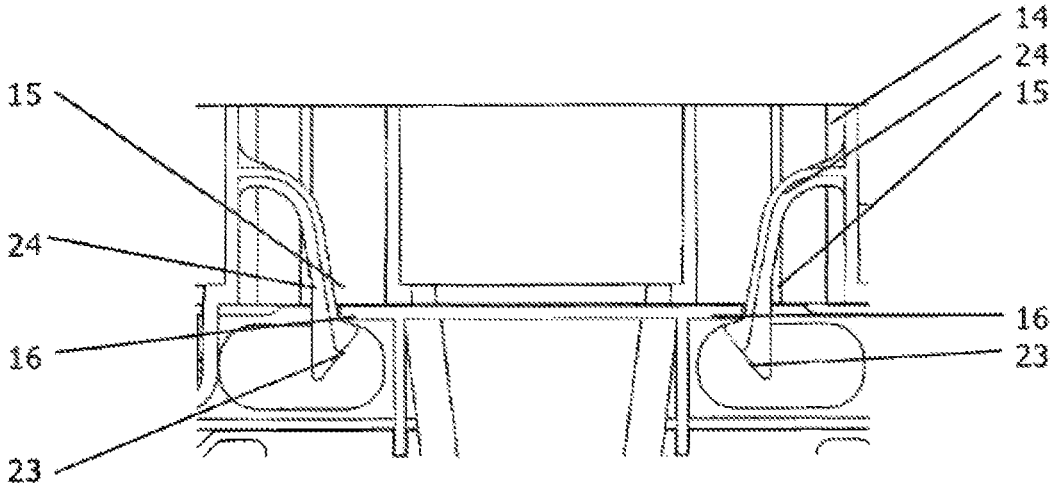
FIG. 5 shows a section through the side wall in the area of the first and second locking elements.

In the example according to FIGS. 1 to 6, the first locking elements 15 are designed as catch elements of the side walls 14, in particular as catch hooks. It can be recognized in the FIGS. 3, 4 that the catch hooks form an undercut which is engaged with a second locking elements 16 of the base plate 11, 12 in order to hold the side wall 14. The second locking element 16 is designed as a counterpart to the catch hooks according to FIGS. 3, 4, specifically as holding and guiding edges (see FIG. 2) behind which the catch hooks engage, as is shown in FIG. 5.

The undercut of the catch hooks and the holding and guiding edges extend in the direction of the height so that the catch hooks can move along the holding and guiding edges.

The holding and guiding edges are formed by recesses in the outer surfaces 17 of the base plates 11, 12. The outer surfaces 17 form the outer circumference of the base plates 11, 12.

Furthermore, it can be recognized in FIG. 5 that the catch hooks are elastically connected to the side walls. The elastic force of the catch hooks is achieved by a bent arm 24 formed on the side wall 14. The side walls 14 and the base plates 11, 12 can be locked to each other. Here, the catch hooks are pressed outward by the holding and guiding edges as a result of the inlet slope 23 and then spring back into the catch position.

Figure 6:
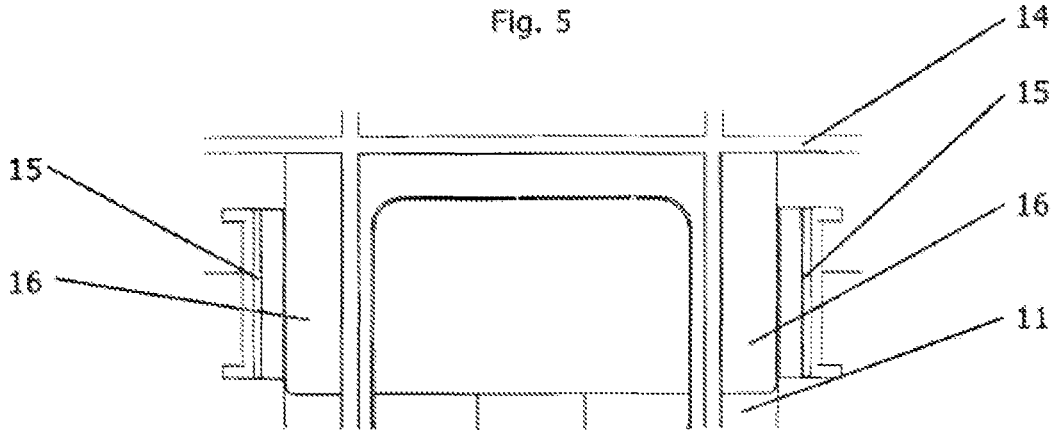
FIG. 6 shows another section through the side wall in the area of the first and second locking elements according to FIG. 5.

FIG. 6 shows that the holding and guiding edges are wider than the catch hooks. This brings it about that the engagement between the catch hooks and the holding and guiding edges reliably takes place at different positions so that a reliable connection is made possible between the side walls 14 and the base plates 11, 12 in very different material combinations.

Figure 7:
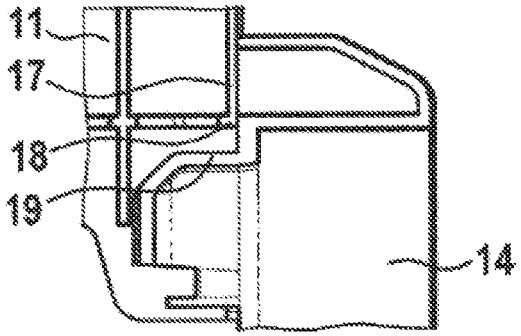
FIG. 7 shows a section through the base plate and the side wall in the area of the outer surface of the base plate.

The side walls 14 rest on the base plates 11, 12 from the outside. This is shown in FIG. 7. To this end, the base plates 11, 12 comprise the previously cited outer surfaces 17, which surround the base plates 11, 12 on the outer circumference and extend in the direction of the height, i.e., upward. The side walls 14 rest on the outer surfaces 17 and can move relative to them in the direction of height. This achieves that the longitudinal compensation between the side walls 14 and the base plates 11, 12 takes place not only in the area of the locking elements 15, 16 but also in the area of the outer surfaces 17. The load removal of the loads introduced into the side walls 14 takes place, among other things, via the outer surfaces 17.

As FIG. 7 shows, the outer surfaces 17 comprise edges 18 which downwardly limit the outer surfaces 17 and extend in the horizontal direction on the circumference of the base plates 11, 12. The edges 18 cooperate with the projections 19 which are formed on the side walls 14 and extend inwardly. An interval in the vertical direction of the drain trench body is formed between the edges 18 and the projections 19. This interval determines the extent of the relative mobility between the side walls 14 and the base plates 11, 12. The edges 18 and the projections 19 therefore act as stops which limit the relative mobility. This prevents that the side walls 14 can loosen in an unintended manner from the base plates 11, 12.

It is conceivable that the stops are formed by other structural components on the base plates 11, 12 on the one hand and on the side walls 14 on the other hand.

FIGS. 8 to 12 relate to another exemplary embodiment of the invention in which the drain trench body comprises a center plate 20 to increase the stability. The center plate 20 extends parallel to the base plates 11, 12 and is provided for receiving transverse forces, especially surface forces, acting on the side walls 14 which can arise, for example, during the insertion of the drain trench body in the groundwater.

Figure 8:
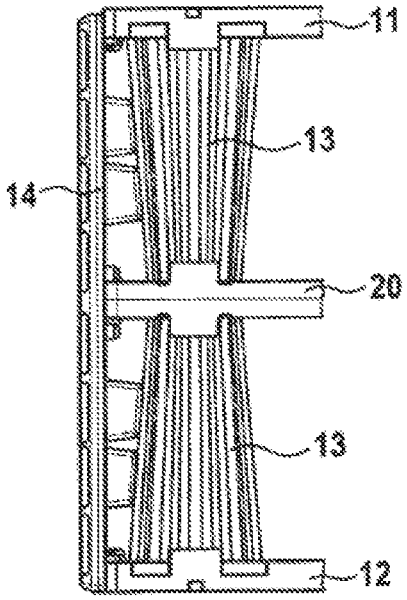
FIG. 8 shows a section through a drain trench body according to another exemplary embodiment with center plate.

FIG. 8 shows that the center plate 20 rests on the inside of a side wall 14 (see also FIG. 9), Specifically, the center plate 20 rests at least on opposite side walls 14 so that forces which are introduced into one of these side walls 14 are optimally transmitted onto the columns 13 and the opposite side wall 14. In the example according to FIGS. 8, 9 the center plate 20 rests on all sides on the side walls 14 so that transverse forces introduced from all sides can be optimally removed.

Figure 9:
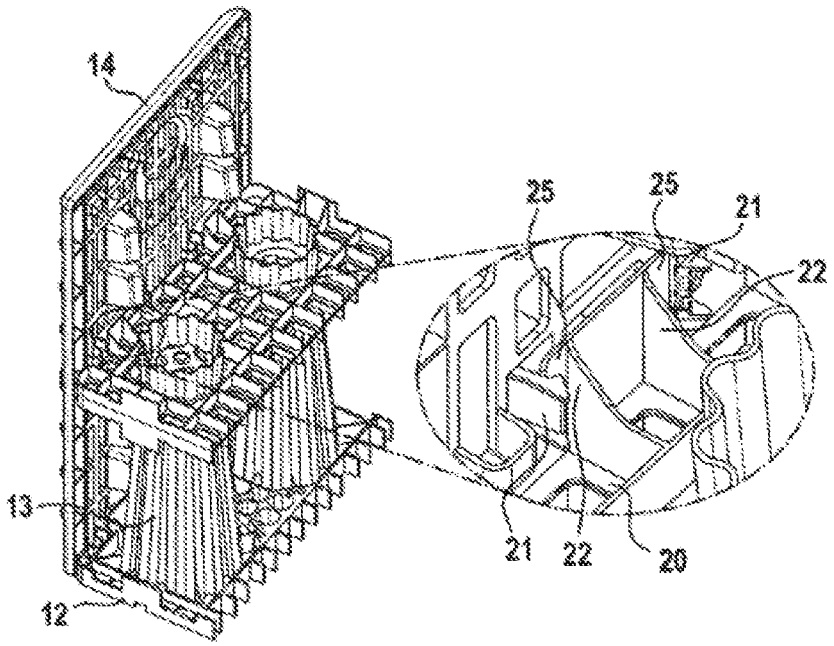
FIG. 9 shows a perspective view with partially sectioned upper columns of the drain trench body according to FIG. 8 with a detailed view in the area of the third and fourth locking elements.

As FIG. 9 shows, the center plate 20 is arranged in the direction of height between the columns 13. To this end, the center plate 20 comprises recesses (not shown) in which the columns 13 are arranged. The recesses can be designed as openings through which the columns 13 extend so that the columns 13 can be or are connected to each other in a known manner.

The side walls 14 comprise third locking elements 21 in the area of the center plate. The center plate 20 comprises fourth locking elements 22. The third and fourth locking elements 21, 22 are engaged with each other and can be moved relative to each other in the direction of the height along the longitudinal axis of the columns 13. The third locking elements 21 are designed in the form of catch hooks, as is shown in the FIGS. 9 and 10. The fourth locking elements 22 are formed by holding and guiding edges. The connection of the center plate 20 to the side walls 14 therefore takes place in a manner corresponding to the connection of the base plates 11, 12 to the side walls 14 by the first and second locking elements 15, 16. Reference in this regard is made to the explanations for the connection between the base plates 11, 12 and the side walls 14.

Differing from the second locking elements 16 of the base plates 11, 12, the fourth locking elements 22 each comprise a nose 25 extending transversely to the direction of movement of the catch hooks. The noses 25 form stops and correspond in their action to the previously described stops formed by the edges 18 and the projections 19.

The side walls 14 can be divided in the exemplary embodiment according to FIGS. 8 to 12. A drain trench body with a divided side wall is shown in the FIGS. 11 and 12.

Figure 10:
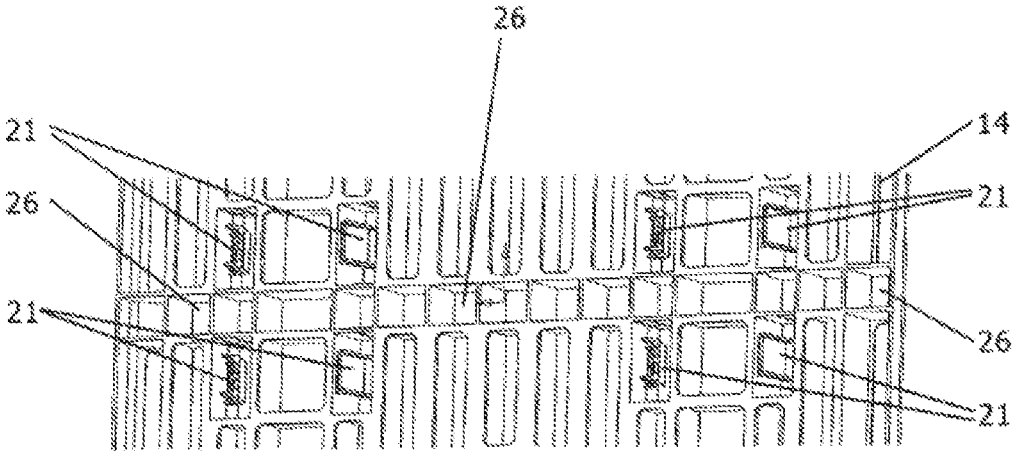
FIG. 10 shows an enlarged section of the side wall according to FIG. 3 in the area of the third and fourth locking elements.

The dividing plane runs parallel to the base plates 11, 12. In addition, a theoretical breaking position or a band-shaped area is provided in the side walls 14. The side wall 14 can be divided in this area, for example, by sawing. The band-shaped area is formed by rectangular perforations 26, as is shown in FIG. 10, which extend over the entire width of the side wall 14. The side wall 14 can be divided in the center along the perforations 26. If a side wall 14 is divided, the two parts have a continuous edge in the area of the (cut) edges. This can prevent that a casing material, e.g., geotextile, optionally surrounding the drain trench body is perforated by the rib structures of the side walls 14.

Figure 11:
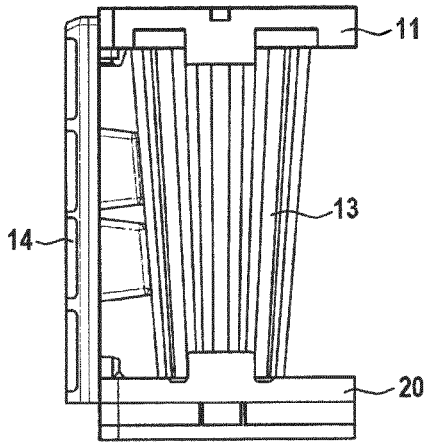
FIG. 11 shows a perspective view of half a drain trench body with divided side wall and center plate.
Figure 12:
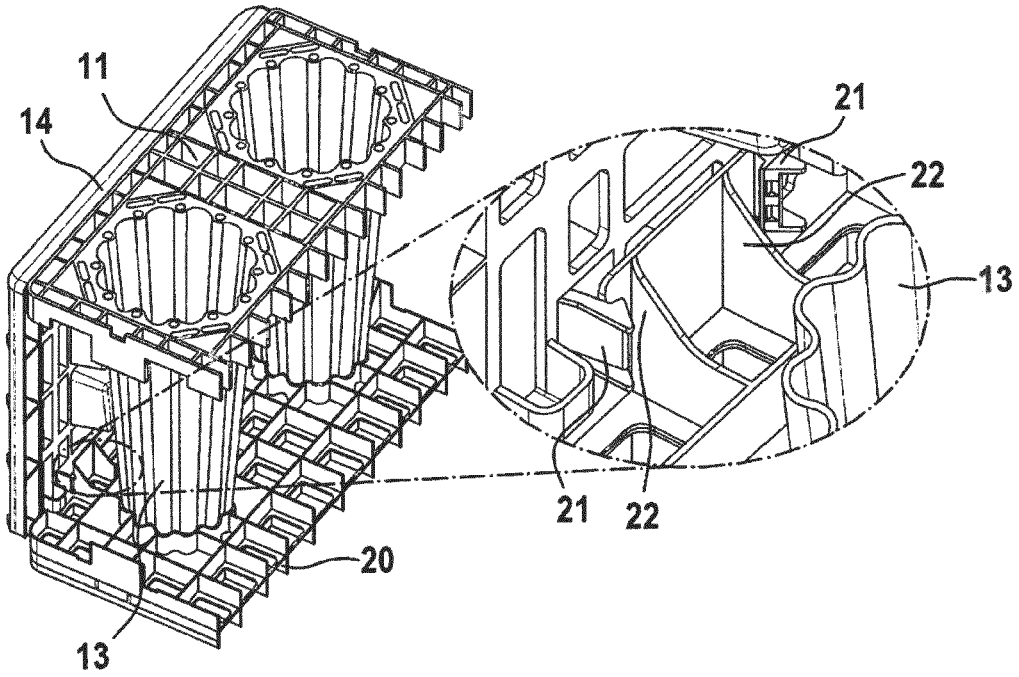
FIG. 12 shows a perspective view of the one-half drain trench body according to FIG. 11 with a detailed view in the area of the third and fourth locking elements.

Furthermore, it can be recognized in FIG. 10 that the third locking elements 21 in the form of catch noses are arranged on both sides of the dividing line or of the perforations 26, i.e., above and below. This has the advantage that the divided side walls 14 can be used to form one half of a drain trench body, as is shown in FIG. 11.

The center plate 20 replaces here one of the two base plates 11, 12 as well as the columns 13 connected to the base plate 11, 12. The one-half chain trench body therefore comprises a base plate 11 with columns 13 which are directly connected to the center plate 20. The side wall 14 is connected on the one hand to the base plate 11 and on the other hand to the center plate 20. Therefore, the center plate 20 forms either the lower bottom plate of the drain trench body or the upper cover plate, depending on the insertion position of the drain trench body. The connection between the center plate 20 and the side wall 14 takes place in a manner corresponding to the connection of the center plate 20 and the undivided side wall 14 according to FIG. 9. Reference is made here to the explanations.

LIST OF REFERENCE NUMERALS

11 first base plate
12 second base plate
13 columns
14 side walls
15 first locking elements
16 second locking elements
17 outer surfaces
18 edges
19 projections
20 center plate
21 third locking elements
22 fourth locking elements
23 inlet slope
24 arm
25 nose
26 perforations

The invention claimed is:

1. A drain trench body comprising base plates (11, 12) between columns (13) that are vertically arranged, and side walls (14) to which the base plates (11, 12) are connected, the side walls (14) and the base plates (11, 12) comprise first and second locking elements (15, 16) which are engaged with one another and can move relative to each other in the direction of height along the longitudinal axis of the columns (13)

wherein the base plates (11, 12) comprise outer surfaces (17) which extend in the direction of height, and the side walls (14) rest on the outer surfaces (17) and can move relative to the outer surfaces (17), wherein the outer surfaces (17) comprise edges (18) and the side walls (14) comprise projections (19) which extend inward and cooperate with the edges (18) as stops for limiting the relative motion of the side walls (14) in the direction of height.

2. The drain trench body of claim 1, wherein the first locking elements (15) are designed as catch elements of the side walls (14), and the second locking elements (16) are designed as holding edges of the base plates (11, 12) that extend in the direction of the height.

3. The drain trench body of claim 1, wherein at least one center plate (20) is arranged parallel to the base plates (11, 12) between the columns (13).

4. The drain trench body of claim 3, wherein the center plate (20) rests on at least one of the side walls (14).

5. The drain trench body of claim 3, wherein the side walls (14) and the center plate (20) comprise third and fourth locking elements (21, 22) which engage with each other and can move relative to each other along the longitudinal axis of the columns (13) in the direction of height.

6. The drain trench body of claim 5, wherein at least one of the side walls (14) can be divided along a virtual dividing plane running parallel to the base plates (11, 12).

7. The drain trench body of claim 6, wherein the third locking elements (21) of the side walls (14) are arranged on both sides of the dividing plane running parallel to the base plates (11, 12).

8. The drain trench body of claim 7, wherein the side walls (14) and the base plates (11, 12) or the central plate (20) are produced from different materials.

9. A center plate (20) with at least one base plate (11, 12) connected to vertically arranged columns (13) and side walls (14), wherein the center plate (20) comprises recesses for the columns (13) for arranging the center plate (20) parallel to the at least one base plate (11, 12), and locking elements (22) configured to engage with corresponding flexible locking elements (21) of the side walls (14)

wherein the locking elements (21) are projections on the side walls, and the locking elements (22) are designed as holding edges of the center plate (20) that extend in the direction of the height.

10. The center plate (20) of claim 9, wherein the locking elements (21, 22) are engaged with one another and can move relative to each other in the direction of height along the longitudinal axis of the columns (13).

11. The center plate (20) of claim 9, wherein each locking element (22) engages with two locking elements (21) disposed on opposing edges of the locking element (22).

* * * * *